US009271558B1

(12) United States Patent
Sandford et al.

(10) Patent No.: US 9,271,558 B1
(45) Date of Patent: Mar. 1, 2016

(54) COLLECTION BAG AND RELATED METHODS

(71) Applicants: Lynn P. Sandford, Orlando, FL (US); Ed Smith, Orlando, FL (US)

(72) Inventors: Lynn P. Sandford, Orlando, FL (US); Ed Smith, Orlando, FL (US)

( * ) Notice: Subject to any disclaimer, the term of this patent is extended or adjusted under 35 U.S.C. 154(b) by 643 days.

(21) Appl. No.: 13/663,024

(22) Filed: Oct. 29, 2012

Related U.S. Application Data

(60) Provisional application No. 61/552,575, filed on Oct. 28, 2011.

(51) Int. Cl.
*A45F 3/10* (2006.01)
*A45F 3/14* (2006.01)
*A45F 3/04* (2006.01)

(52) U.S. Cl.
CPC ..... *A45F 3/04* (2013.01)

(58) Field of Classification Search
CPC ..... B65D 33/00; A45F 3/04; A45F 2003/002; A45F 3/00
See application file for complete search history.

(56) References Cited

U.S. PATENT DOCUMENTS

| | | | | | |
|---|---|---|---|---|---|
| 719,810 | A | * | 2/1903 | Jones | 224/601 |
| 986,573 | A | * | 3/1911 | Jackson | 224/647 |
| 1,137,303 | A | * | 4/1915 | Carpenter | 224/630 |
| 1,394,197 | A | * | 10/1921 | Keeline | 383/33 |
| 1,459,599 | A | * | 6/1923 | Minor | 232/43.1 |
| 1,645,360 | A | * | 10/1927 | Taylor | 224/611 |
| 2,276,087 | A | * | 3/1942 | Petersen | 232/43.1 |
| 3,838,758 | A | * | 10/1974 | Brown | 383/38 |
| 4,213,549 | A | * | 7/1980 | Hibbard | 224/601 |
| 4,739,913 | A | | 4/1988 | Moore | |
| 4,925,071 | A | * | 5/1990 | Fleming et al. | 224/604 |
| 5,012,964 | A | * | 5/1991 | Falletta et al. | 224/153 |
| 5,201,446 | A | * | 4/1993 | Martin | 224/604 |
| 5,230,566 | A | * | 7/1993 | Jackson et al. | 383/66 |
| 5,288,150 | A | | 2/1994 | Bearman | |
| 5,673,836 | A | * | 10/1997 | Bush | 224/576 |
| 5,779,036 | A | * | 7/1998 | Westbrook et al. | 206/292 |
| 5,826,771 | A | * | 10/1998 | Peng | 224/651 |
| 5,879,083 | A | * | 3/1999 | Nelson et al. | 383/67 |
| D428,249 | S | * | 7/2000 | Ash, Jr. | D3/217 |
| 6,419,135 | B1 | * | 7/2002 | Sali | 224/610 |
| 6,513,661 | B1 | * | 2/2003 | Mogil | 206/579 |
| 6,652,339 | B1 | | 11/2003 | Carmichael | |

(Continued)

OTHER PUBLICATIONS

UniBag Underwater Kinetics Gear, Snorkel or Beach Bag at JoeDiverAmerica.com at http;//webarchive.org/web/20091222093117/http://www.joediveramerica.com/page/JDA . . . Oct. 22, 2012. Product on sale as of Dec. 22, 2009.

*Primary Examiner* — Brian D Nash
(74) *Attorney, Agent, or Firm* — Allen Dyer Doppelt Milbrath & Gilchrist

(57) ABSTRACT

A collection bag has a bag body sized to fit along a wearer's torso. A back wall of the bag body is positionable in contact with the wearer's torso. A front wall is opposite the back wall. The back wall is formed from material that is generally impervious to items in the bag, while the front wall is generally pervious to water flow. The front and back walls are joined together along lateral and longitudinal margins to define the interior of the bag. Attachment members are attached to the bag body for supporting the weight of the bag body against the wearer's torso. A first sealable opening through the front wall allows the wearer to place collected items into the bag. A second sealable opening positioned along the lateral margin near the wearer's waste region allows the wearer to easily empty collected items from the bag.

21 Claims, 5 Drawing Sheets

(56) References Cited

U.S. PATENT DOCUMENTS 6,860,773 B2 3/2005 Carmichael
8,152,374 B2 * 4/2012 Shaul ..... 383/37
2005/0077329 A1 * 4/2005 Sconzo ..... 224/153
2009/0206118 A1 * 8/2009 Sabbah ..... 224/652
2012/0102811 A1 5/2012 Waugh
2013/0292432 A1 * 11/2013 Stevens ..... 224/184

* cited by examiner

COLLECTION BAG AND RELATED METHODS

CROSS-REFERENCE TO RELATED APPLICATION

This claims the benefit of provisional application No. 61/552,575 filed Oct. 28, 2011 and titled "Wearable Bag for Collecting Articles Located Underwater," which is incorporated by reference in its entirety.

FIELD OF THE INVENTION

The invention relates to the field of wearable bags, particularly, wearable bags designed to collect items that are aquatically submerged.

BACKGROUND

Scalloping is a popular activity in which waders, swimmers, divers, and snorkelers retrieve aquatically submerged scallops for consumption. It is conventionally performed using a mesh collection bag having an opening on one end that is closeable by pulling a draw string or the like. In practice, the user typically swims beneath the water, filling the mesh bag with scallops.

Although using such mesh bags is effective, it has several disadvantages. Because the user typically carries the bag with one hand and swims using the other, the bag inhibits the user's ability to swim. This problem is compounded as the user collects more and more scallops because the bag eventually grows so heavy that swimming and carrying the bag at the same is nearly impossible. Accordingly, the user often has to empty the bag frequently. In order to free the hands for swimming, the mesh collection may be attached to the user's body via some type of strap. Unfortunately, these collection bags must still be emptied frequently and inhibit the user's ability to swim by interfering with the user's arms and/or legs.

SUMMARY

Figure 1:
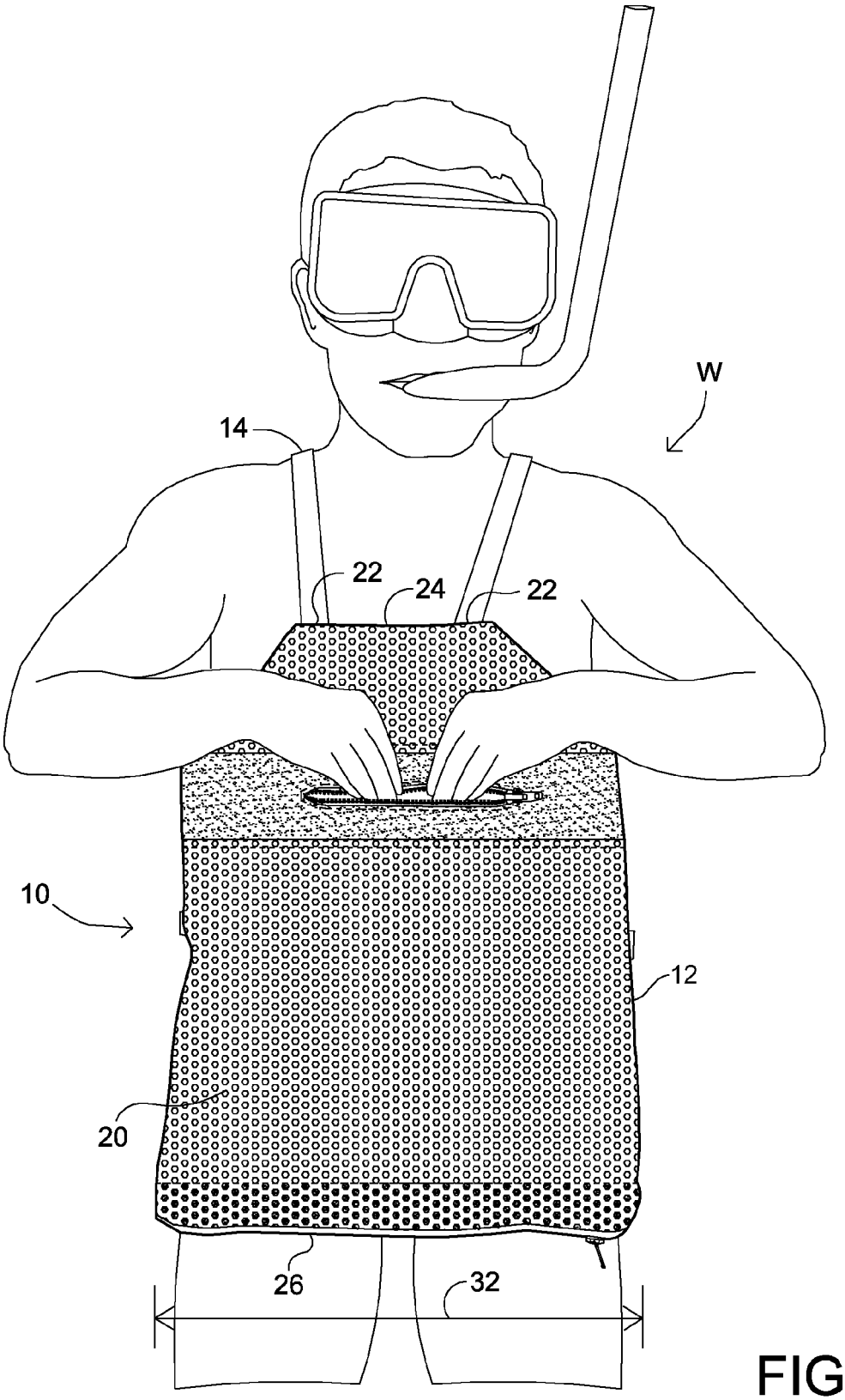
FIG. 1 is a front view of a collection bag according to an embodiment of the invention as it is typically worn by a wearer.

The inventors recognized that collection bags could be improved by making them attachable to the wearer's torso in such a way that interference with the user's arms and legs is minimized and the weight of the collected items is more or less evenly distributed about the wearer's torso during swimming. This allows the wearer to remain substantially balanced and for his or her appendages to remain substantially unobstructed while swimming.

A collection bag embodying these principles has a bag body sized to fit across a wearer's torso and extend from the wearers chest region to the wearer's waste region. The bag body has a back wall that is positionable in contact with the wearer's torso and a front wall opposite the back wall. The back wall is formed from material that is generally impervious to items in the bag, while the front wall is generally pervious to water flow. The front wall and back wall are joined together along lateral and longitudinal margins to define the interior of the bag.

A set of attachment members is attached to the bag body for supporting the weight of the bag body against the wearer's torso. A first sealable opening through the front wall allows the wearer to place collected items into the bag. A second sealable opening positioned along the lateral margin near the wearer's waste region allows the wearer to easily empty collected items from the bag.

Optionally, the second sealable opening may extend substantially completely across the lateral margin near the wearer's waste region between the opposing longitudinal margins. This arrangement helps with emptying the bag because it minimizes areas in which collected items can become trapped.

Also optionally, the second attachment member may be attached to the bag body at a position located apart from the second sealable opening and between the second sealable opening and the first attachment member. This arrangement allows the wearer to direct the contents of the bag away from the wearer's legs when emptying the bag.

These and other objects, aspects, and advantages of the present invention will be better appreciated in view of the following detailed description of preferred embodiments.

DETAILED DESCRIPTION OF PREFERRED EMBODIMENTS

In the Summary above and in the Detailed Description of Preferred Embodiments, reference is made to particular features (including method steps) of the invention. Where a particular feature is disclosed in the context of a particular aspect or embodiment of the invention, that feature can also be used, to the extent possible, in combination with and/or in the context of other particular aspects and embodiments of the invention, and in the invention generally.

The term "comprises" is used herein to mean that other features or steps are optionally present. When reference is made herein to a method comprising two or more defined steps, the steps can be carried in any order or simultaneously (except where the context excludes that possibility), and the method can include one or more steps which are carried out before any of the defined steps, between two of the defined steps, or after all of the defined steps (except where the context excludes that possibility).

In this section, the invention will be described more fully with reference to certain preferred embodiments. This invention may, however, be embodied in many different forms and should not be construed as limited to the embodiments set forth herein. Rather, these embodiments are provided so that this disclosure will convey preferred embodiments of the invention to those skilled in the art.

Figure 2:
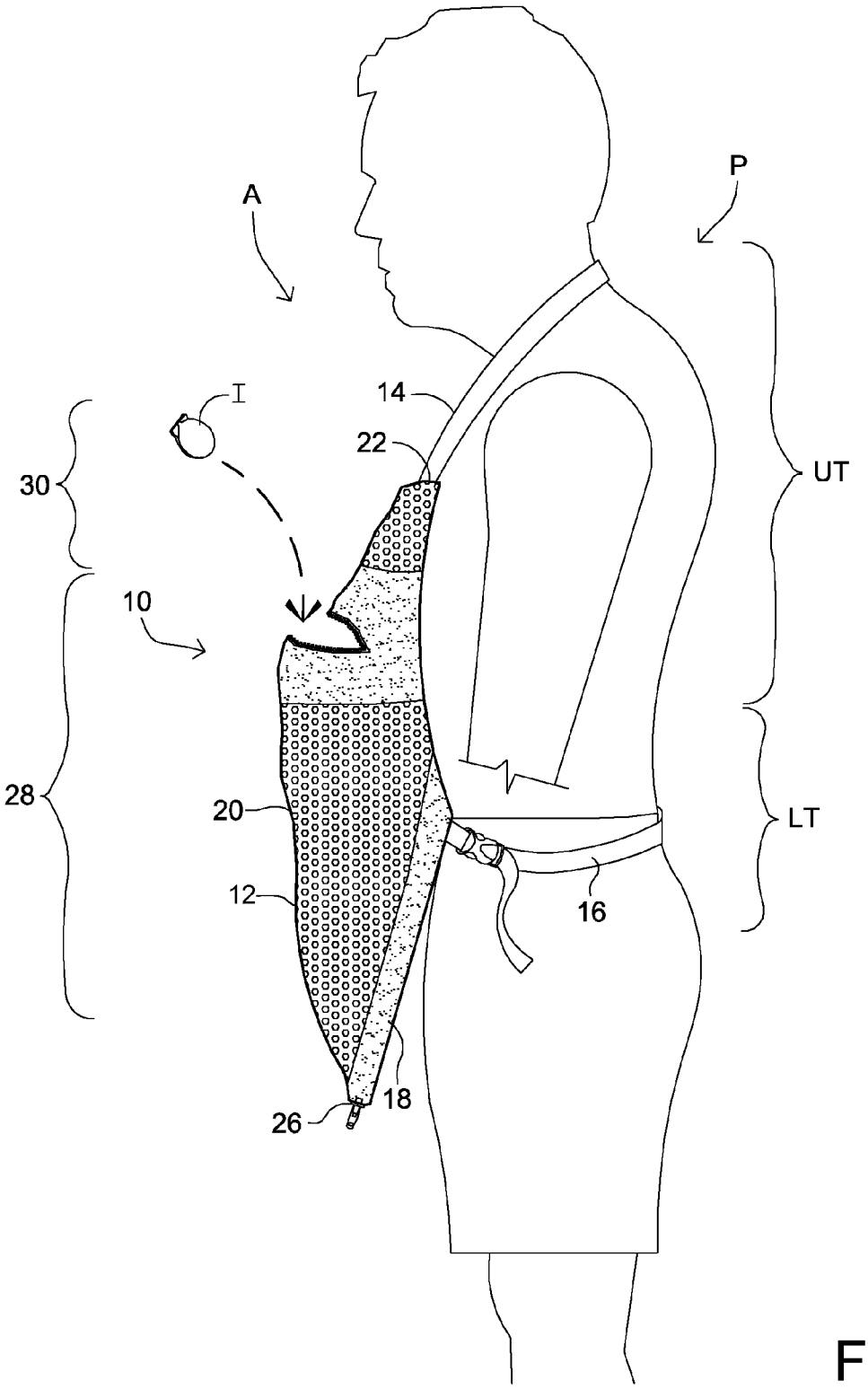
FIG. 2 is a side view of the bag of FIG. 1 as it is typically worn by the wearer, where the mask and snorkel have been removed.

Referring initially to FIGS. 1 and 2, a collection bag according to an embodiment of the invention is generally shown being worn by a wearer W about the wearer's torso. Although the wearer W is not part of the invention, the bag 10 is described with reference to portions of the wearer's torso for ease of reference. The portions of the wearer's torso to which this disclosure refers are an upper torso UT, lower torso LT, anterior side A, and posterior side P.

The bag 10 has a bag body 12 forming the bag structure and a first 14 and second attachment 16 member for attaching the bag body 12 to the wearer's torso. The shape of the bag body 12 and arrangement of the attachment members, 14, 16 are advantageously selected to allow a wearer W to wear the bag 10 about the wearer's anterior torso A while swimming, diving, and/or snorkeling and minimize interference between the bag 10 and the wearer's arms and legs while doing so. When being worn, a back wall 18 of the bag body 12 is positioned against the wearer's anterior torso A so that a front wall 20, adapted to allow the wearer W to insert and remove collected items I from within the bag body 12, is easily accessible by the wearer's hands.

Because collected items I within the bag body 12 may be sharp or irritating to the wearer's skin or clothes, the back wall 18 is preferably formed from material that is generally impervious to collected items. Preferably, the back wall 18 is formed from a solid panel of fabric material that is both flexible and lightweight such as nylon or polyester, or the like.

On the other hand, the front wall 20 is formed from material that is generally pervious to water flow for allowing water to easily drain from the bag 10. Preferably, the front wall 20 is at least partially formed from a mesh fabric material that is also both flexible and lightweight such as nylon or polyester, or the like.

The first attachment member 14 is attached to the bag body 12 and extends outwardly from a pair of laterally opposing attachment points 22 at an upper end 24 of the bag body 12. The first attachment member 14 is attached to the wearer's upper torso UT by extending over the wearer's shoulders and behind the neck. This allows the first attachment member 14 to support the weight of the bag body 12 and any collected items I therein against the wearer's upper torso UT.

From the upper end 24, which is positioned below the wearer's neck, the bag body 12 extends downwardly across the wearer's chest region towards the wearer's lower torso LT where it terminates at a lower end 26 in the vicinity of the wearer's waste region. The second attachment member 16 is attached to the bag body 12 and is capable of attaching the bag body 12 to the wearer's lower torso LT and supporting the weight of the bag body 12 and any collected items I therein against the wearer's lower torso LT.

The second attachment member 16 is especially advantageous when the wearer W is in a prone position such as when swimming, diving, snorkeling, or leaning over to pick up an item because it prevents the lower end 26 of the bag body 12 from substantially displacing from the wearer's lower torso LT. This prevents the bag body 12 from interfering with the wearer's arms and legs. The second attachment member 16 is also displaced from the lower end 26 along the back wall 18 so that a portion of a lower section 28 of the bag body 12 between the second attachment member 16 and lower end 26 can easily be manipulated by the wearer W, which is particularly important when removing items I from the bag 10 as it allows the wearer W to direct the items I away from the wearer's legs.

The bag body 12 includes an upper section 30 that tapers outwardly towards the lower end 26. The lower section 28 is generally rectangular. The tapered shape of the upper section 30 helps to prevent the bag body 12 from contacting the wearer's shoulders, while the generally rectangular shape of the lower section 28 more or less mimics the outline of the wearer's lower torso LT. In this regard, the width of the lower section preferably approximates the width 32 of the wearer's anterior torso A to prevent the bag body 12 from interfering with the wearer's arms and legs when in use.

Figure 3:
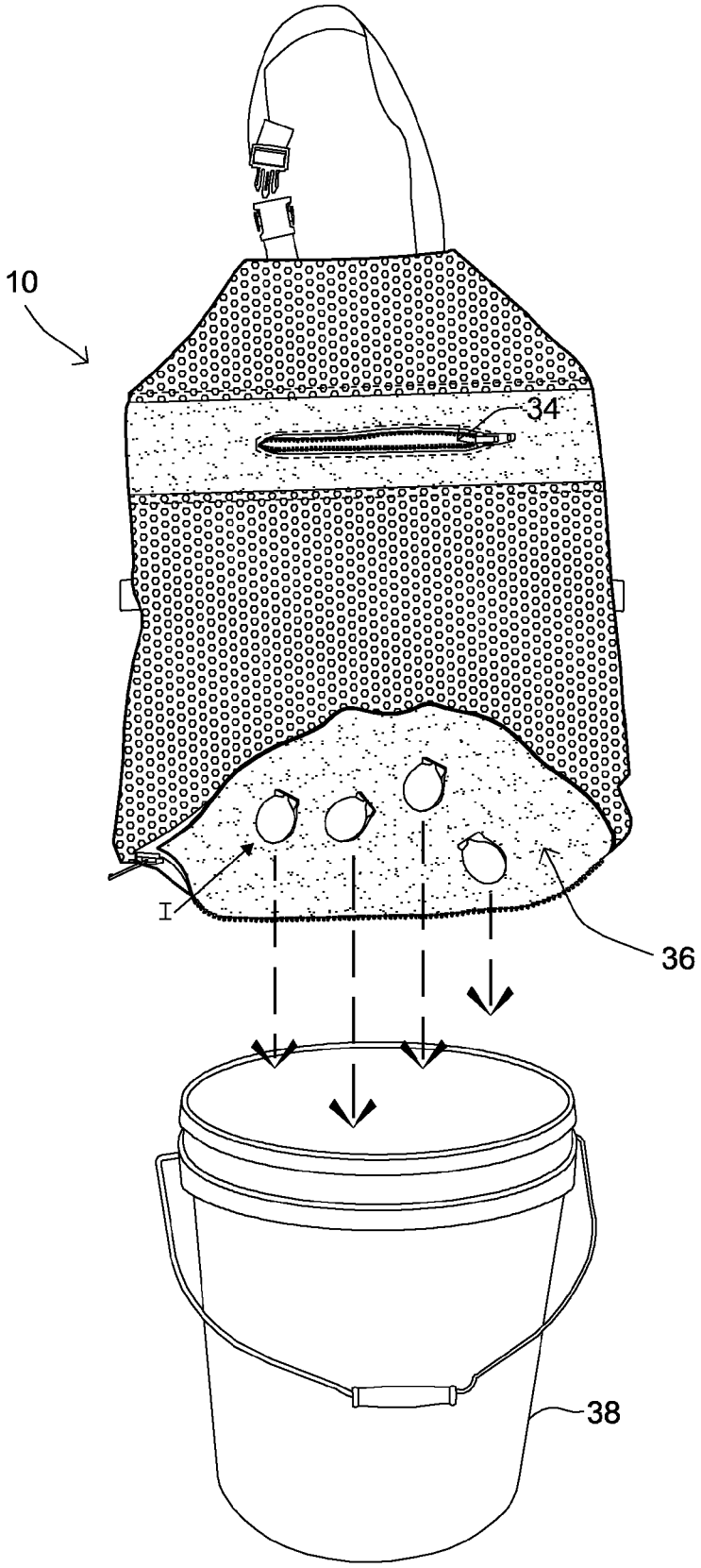
FIG. 3 is a front perspective view of the bag of FIG. 1, illustrating the second sealable opening in an open position and collected items being emptied from the bag into a container.

Referring now to FIG. 3, in addition to FIGS. 1 and 2, the bag 10 includes a first sealable opening 34 through the front wall for inserting collected items I into an interior space of bag 10 and a second sealable opening 36 for removing the collected items I from the interior space. As illustrated, in use, the bag 10 is easily emptied by placing the second sealable opening 36 over a container 38 and allowing the force of gravity to pull the items I out of the bag 10.

Additional details about the bag 10 are now described with reference to FIGS. 4 and 5. The front wall 20 and the back wall 18 have a generally common shape and are joined together along lateral margins 40 and longitudinal margins 42 of the bag body 12 to form the interior space for receiving and storing collected items therein. The panels may be joined together using a conventional technique for joining fabric pieces together, such as by sewing, adhering, or the like.

The first sealable opening 34 is positioned through the front wall 20 at a location that is adapted to provide easy access to the interior space but also prevent collected items from falling out when it is open. The first sealable opening 34 is located along the front wall 20 is such that it will sit at about the chest level of the wearer W when worn. This allows the wearer W to access it easily with the wearer's hands. Further, because collected items will tend to move toward the lower end 26, the first sealable opening 34 is located far enough therefrom to provide a substantial amount of interior space in the lower section 28 for the items to settle. Unless the wearer W fills the interior space with so many items that the items flow over the first sealable opening 34, which will rarely be the case, the items will settle at a level that falls below the first sealable opening 34.

The first sealable opening 34 extends substantially parallel to the lateral margins 40 between a pair of opposing terminal ends 44 that are located at about the position of the wearer's right and left breast respectively. This provides enough of an opening for the wearer W to insert one or two handsful of items, but reduces the likelihood of spills that would occur if the first sealable opening 34 extended the complete distance between the longitudinal margins 42. The first sealable opening 34 is laterally sealable using a first sealing mechanism 46 such as a zipper, hook and loop fastener, buttons, or the like. A zipper is particularly preferred because the wearer W can easily manipulate it with one hand. It is also strong enough to withstand being struck over and over with collected items that have sharp and/or abrasive surfaces.

The portion of the front wall 20 through which the first sealable opening 34 is positioned is preferably, but not necessarily always, formed from material that is substantially impervious to items in the bag 10, such as the material from which the back wall 18 is formed. In the embodiment shown, an upper panel 48 of this material laterally extends between the longitudinal margins 42 and longitudinally extends a few inches about the first sealable opening 34. The top and bottom of the upper panel are attached to the substantially water pervious material along respective seams 50.

If employed, the upper panel 48 serves several advantageous functions. First, the upper panel 48 prevents damage that may occur to the front wall 20 in the vicinity of the first sealing mechanism 46 from being struck over and over by the sharp and/or abrasive surfaces of collected items. By way of example, if the entire front wall 20 is made from a substantially water pervious material such as mesh fabric, the mesh fabric would have the tendency to rip and tear over time, which would weaken the structural integrity of the front wall 20 around the first sealing mechanism 46. The upper panel also provides a tactile mechanism for indicating when wearer's hand is near the first sealable opening 34, which is particularly important when the wearer's W vision is impaired by diving or snorkeling gear.

The second sealable opening 36 is positioned along the lateral margin 40 at the lower end 26 of the bag body 12. It preferably extends substantially completely across the lateral margin 40 between the opposing longitudinal margins 42 to minimize the ability of collected items to gather in the corners joining the lateral margin 40 at the lower end 26 and the longitudinal margins 42. The second sealable opening 36 is sealable with a second sealing mechanism 52, which may be the same or a different sealing mechanism compared to the first sealing mechanism 46. In a preferred embodiment, however, a zipper is employed for the same reasons described above. When the second sealing mechanism 52 is sealed, the second sealing mechanism 52 joins the front and back walls along the lateral margin at the lower end, thereby further minimizing space for collected items to become trapped in the bag body 12.

A lower panel 60 of the material substantially impervious to collected items extends between the longitudinal margins 42 adjacent to the lower end 26 of the bag body 12. The lower panel 60 is placed along the front wall 20 in the interior space to provide a barrier between the substantially water pervious material and collected items. This positioning is advantageous because it prevents the collected items I, which will settle at the lower end 26, from damaging the substantially water pervious material.

Figure 4:
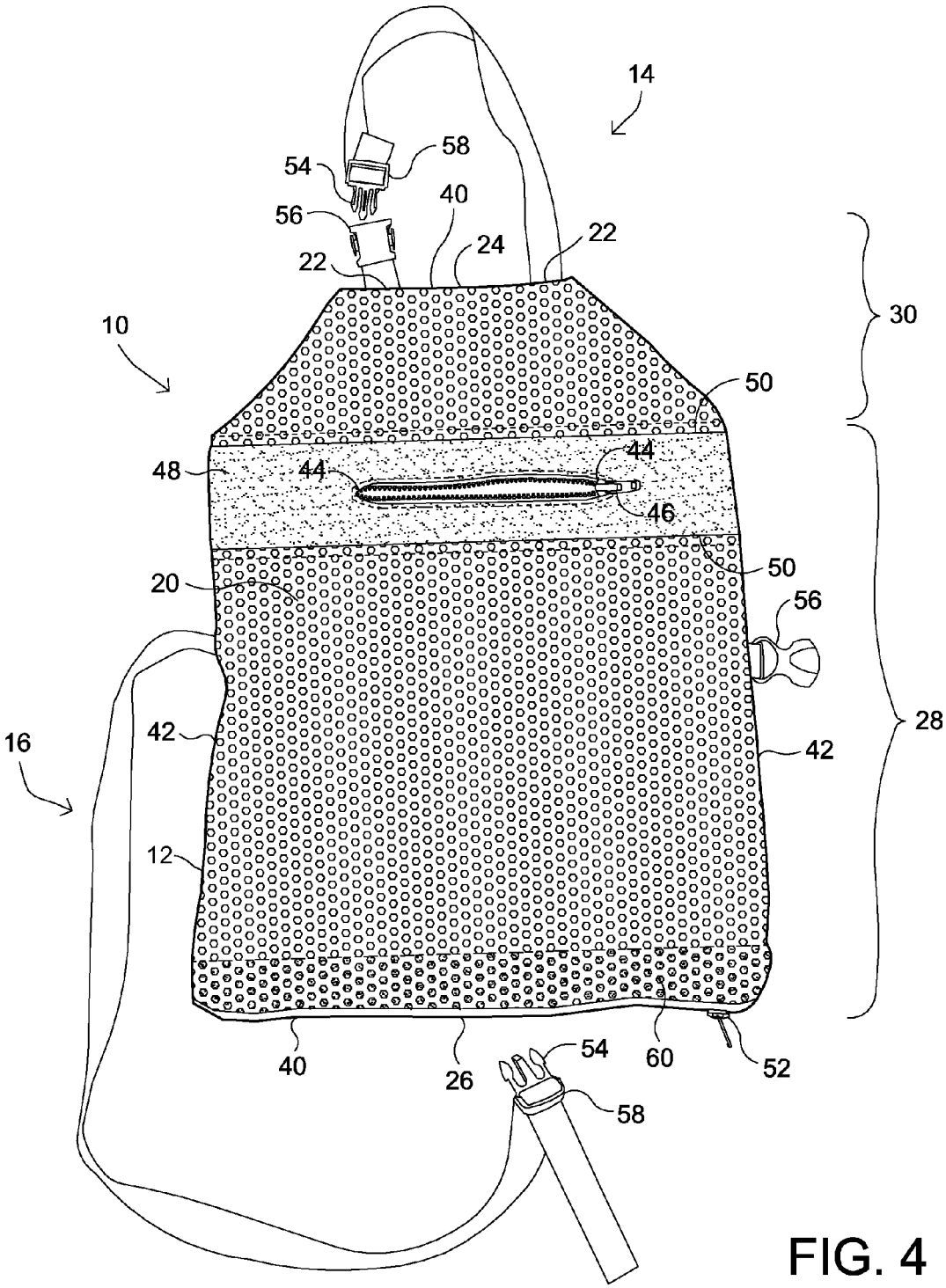
FIG. 4 is a front view of the bag of FIG. 1.
Figure 5:
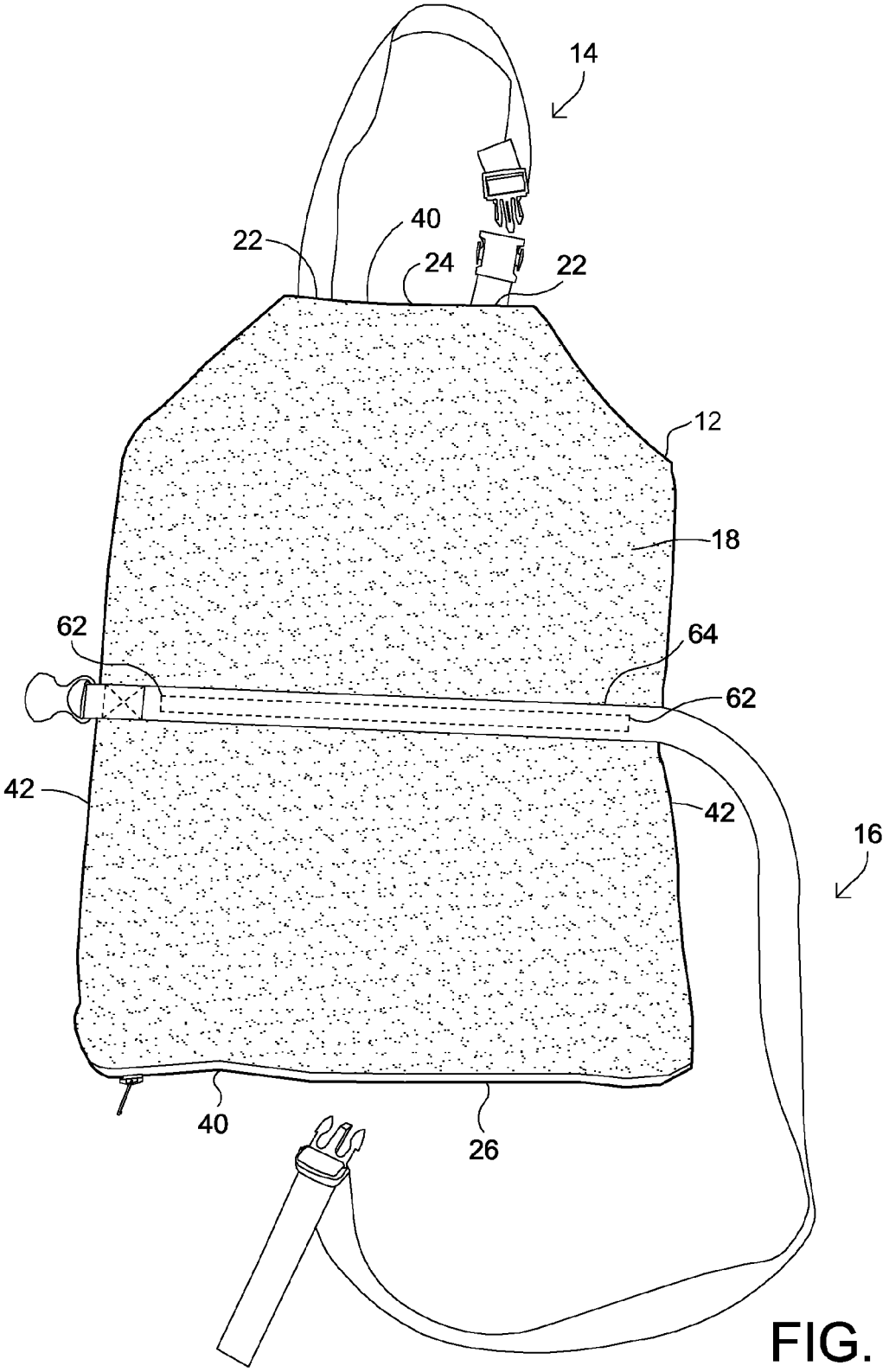
FIG. 5 is a back view of the bag of FIG. 1.

As best shown in FIGS. 4 and 5 the first 14 and second attachment members preferably form straps that have adjustable lengths and fasteners for connecting opposing ends of the straps together. The fasteners include a conventional male fastener 54 and mating female fastener 56. In the preferred embodiment shown, the male 54 and female 56 fasteners are mating pairs of a conventional side release buckle. The length of the straps is adjustable by pulling the tag end of the strap through a conventional tension lock strap adjuster 58 attached to the male fastener 54. In the event that the wearer W needs to quickly remove the bag 10 from the wearer's body, which could be the case if the bag 10 gets caught on an aquatically submerged obstruction, the wearer W can easily disengage the male 54 and female 56 fasteners from one another.

The second attachment member 16 is attached to the back wall 18 and extends laterally therefrom at a pair of laterally opposing attachment points 62. The attachment points are laterally spaced from the lonjitudinel margins 42 by substantially the same amount. The attachment points 62 are joined together by a seam 64 extending therebetween, which is formed by sewing the second attachment member 16 to the back wall 18.

Methods of collecting items, using the bag 10 are now described. In use, the wearer W positions the bag 10 across the wearer's torso so that it extends from the upper end 24 adjacent to the wearer's chest region to the lower end 26 adjacent to the wearer's waste region. The back wall 18 of the bag body 12 is then in contact with the anterior A of the wearer's torso. The wearer W attaches the first attachment member 14 to the wearer's upper torso UT and the second attachment member 16 to the wearer's lower torso LT. The wearer W will typically insert collected items I through the first sealable opening 34 and subsequently seal it so that collected items I cannot escape. The wearer W then removes the collected items I from the interior space by opening the second sealable opening 36. Small particles such as sand and dirt can be easily rinsed away prior to emptying the collected items I from the bag by flowing water through the substantially water pervious front wall 20.

As discussed previously, the method is particularly advantageous when the collected items I are aquatically submerged as the bag 10 is advantageously designed with this scenario in mind. In this case, the collected items I may be mollusks, crustaceans, treasure, or shells, among many other possibilities. It is important to understand, however, that uses of the bag are not limited to collecting aquatically submerged items. For example, the bag 10 may be used to collect produce such as fruits and vegetables. In this case, the bag 10 is particularly advantageous as the produce can be rinsed by flowing water through the substantially water pervious front wall 20 before the produce is even removed from the bag 10. As will be appreciated, there are a plethora of other items that the bag can be used to collect.

The invention has been described above with reference to preferred embodiments. Although various methods and materials similar or equivalent to those described herein can be used in the practice or testing of the present invention, suitable methods and materials are described. However, the skilled should understand that the methods and materials used and described are examples and may not be the only ones suitable for use in the invention.

That which is claimed is:

1. A collection bag comprising:

a bag body for fitting across a wearer's torso and extending from an upper end adjacent to the wearer's chest region to a lower end adjacent to the wearer's waste region;

the bag body having a back wall positionable in contact with the wearer's torso and a front wall opposite the back wall, the back wall and front wall having generally common shape and being joined together along lateral and longitudinal margins to define an interior space therebetween, the back wall being formed from material generally impervious to items in the interior space, the front wall being formed from material generally pervious to water flow;

a first attachment member capable of attaching the bag body to the wearer's upper torso and supporting the weight of the bag body thereagainst;

a second attachment member capable of attaching the bag body to the wearer's lower torso and supporting the weight of the bag body thereagainst;

a first sealable opening through the front wall, the first sealable opening being located over the wearer's chest region when the first and second attachment members are attached to the wearer's torso; and a second sealable opening positioned along the lateral margin located at the lower end.

2. The bag of claim 1, wherein the second sealable opening extends substantially completely across the lateral margin on the lower end between opposing longitudinal margins.

3. The bag of claim 2, wherein the back wall and front wall are joined together at the lateral margin on the lower end between opposing longitudinal margins by the second sealable opening when the second sealable opening is sealed.

4. The bag of claim 1, wherein the second attachment member is attached to the bag body at a position located apart from the second sealable opening and between the second sealable opening and first attachment member.

5. The bag of claim 4, wherein the second attachment member is attached to the bag body at a pair of laterally opposing attachment points on the back wall, the attachment points being inwardly spaced apart from the longitudinal margins by substantially the same amount.

6. The bag of claim 5, wherein the second attachment member includes a strap extendable outwardly from the laterally opposing attachment points and around the wearer's waste region, the strap having a connector capable of releasably connecting opposing ends of the strap and a mechanism for adjusting a length of the strap.

7. The bag of claim 1, wherein:

the second sealable opening extends substantially completely across the lateral margin at the lower end between opposing longitudinal margins; and the second attachment member is attached to the bag body at a position located apart from the second sealable opening and between the second sealable opening and first attachment member.

8. The bag of claim 7, wherein the second attachment member is attached to the bag body at a pair of laterally opposing attachment points on the back wall, the attachment points being inwardly spaced apart from the longitudinal margins by substantially the same amount.

9. The bag of claim 8, wherein the second attachment member includes a strap extendable outwardly from the laterally opposing attachment points and around the wearer's waste region, the strap having a connector capable of releasably connecting opposing ends of the strap and a mechanism for adjusting a length of the strap.

10. The bag of claim 9, wherein the back wall and front wall are joined together at the lateral margin on the lower end between opposing longitudinal margins by the second sealable opening when the second sealable opening is sealed.

11. The bag of claim 1, wherein the first attachment member is connected to the bag body at a pair of laterally opposing attachment points and extends outwardly from the upper end away from the lower end.

12. The bag of claim 11, wherein the first attachment member includes a strap positionable over the shoulders and around the neck of the wearer.

13. The bag of claim 12, wherein the strap includes a connector capable of releasably connecting opposing ends of the strap and a mechanism for adjusting a length of the strap.

14. The bag of claim 1, wherein the front wall comprises:

a first panel made of the material generally pervious to water flow and located adjacent to the upper end;

a second panel made of the material generally pervious to water flow and located adjacent to the lower end; and a third panel made of material generally impervious to items in the interior space;

wherein the first sealable opening is formed through the third panel.

15. The bag of claim 14, wherein the front wall further comprises:

A fourth panel made of material generally impervious to items in the interior space, the fourth panel being positioned within the interior space, extending substantially completely between the longitudinal margins at the lower end, and abutting the second sealable opening.

16. The bag of claim 15, wherein:

the second sealable opening extends substantially completely across the lateral margin at the lower end between opposing longitudinal margins;

the back wall and front wall are joined together at the lateral margin on the lower end between opposing longitudinal margins by the second sealable opening when the second sealable opening is sealed;

the second attachment member is attached to the bag body at a position located apart from the second sealable opening and between the second sealable opening and first attachment member;

the second attachment member is attached to the bag body at a pair of laterally opposing attachment points on the back wall, the attachment points being inwardly spaced apart from the longitudinal margins by substantially the same amount, the second attachment member having a second attachment member strap extendable outwardly from the laterally opposing attachment points and around the wearer's waste region, the second attachment member strap having a connector capable of releasably connecting opposing ends of the second attachment member strap and a mechanism for adjusting a length of the second attachment member strap.

17. The bag of claim 16, wherein the first attachment member is connected to the bag body at a pair of laterally opposing attachment points and extends outwardly from the upper end away from the lower end, the first attachment member having a first attachment member strap positionable over the shoulders and around the neck of the wearer, the first attachment member strap having a connector capable of releasably connecting opposing ends of the first attachment member strap and a mechanism for adjusting a length of the first attachment member strap.

18. A method of collecting items, the method comprising:

positioning a bag across a wearer's torso from an upper end adjacent to the wearer's chest region to a lower end adjacent to the wearer's waste region, the bag comprising:

a bag body having a back wall in contact with an anterior of the wearer's torso and a front wall opposite the back wall, the back wall and front wall having generally common shape and being joined together along lateral and longitudinal margins to define an interior space therebetween, the back wall being formed from material generally impervious to items in the interior space, the front wall being formed from material generally pervious to water flow;

a first attachment member attaching the bag body to the wearer's upper torso and supporting the weight of the bag body thereagainst;

a second attachment member attaching the bag body to the wearer's lower torso and supporting the weight of the bag body thereagainst;

a first sealable opening through the front wall, the first sealable opening being located over the wearer's chest region; and a second sealable opening positioned along the lateral margin located at the lower end;

inserting collected items through the first sealable opening;

sealing the first sealable opening; and removing the collected articles from the interior space by opening the second sealable opening.

19. The method of claim 18, wherein removing is achieved while the bag body is attached to the wearer.

20. The method of claim 18, wherein removing is at least partially achieved by flowing water through the front wall and out the second sealable opening.

21. The method of claim 18, wherein inserting is achieved while the wearer is at least partially aquatically submerged.

* * * * *